US009295317B1

(12) United States Patent
Achiaz

(10) Patent No.: US 9,295,317 B1
(45) Date of Patent: Mar. 29, 2016

(54) FOOTWEAR HANGER

(71) Applicant: Itai Achiaz, Herzelia (IL)

(72) Inventor: Itai Achiaz, Herzelia (IL)

( * ) Notice: Subject to any disclaimer, the term of this patent is extended or adjusted under 35 U.S.C. 154(b) by 0 days.

(21) Appl. No.: 14/755,696

(22) Filed: Jun. 30, 2015

(51) Int. Cl.
*A45F 3/08* (2006.01)
*A45F 3/04* (2006.01)
*A45F 3/00* (2006.01)

(52) U.S. Cl.
CPC . *A45F 3/08* (2013.01); *A45F 3/042* (2013.01); *A45F 2003/001* (2013.01)

(58) Field of Classification Search
CPC ..... A43C 19/00; A45F 5/021; A45F 3/08; A45F 3/042; A45F 2003/001; Y10S 224/904
USPC ..... 224/660, 269, 666–670, 603–605, 647, 224/904; 24/712.9, 713.2, 713.4
See application file for complete search history.

(56) References Cited

U.S. PATENT DOCUMENTS 493,202 A * 3/1893 Abney ..... A43C 7/00 24/712.7
2,697,296 A * 12/1954 Steele ..... A01K 97/04 224/241
5,301,857 A * 4/1994 Green ..... A45F 5/02 215/365
2002/0030072 A1* 3/2002 Schleifer ..... A43B 5/0425 224/257
2003/0141332 A1* 7/2003 Rivera ..... A45F 5/02 224/245
2006/0186150 A1* 8/2006 Willows ..... A45F 3/00 224/222
2013/0199006 A1* 8/2013 Harris ..... A43C 7/00 24/712.2

FOREIGN PATENT DOCUMENTS

WO WO2011145127 * 11/2011

* cited by examiner

*Primary Examiner* — Justin Larson
*Assistant Examiner* — Scott McNurlen
(74) *Attorney, Agent, or Firm* — Troutman Sanders LLP

(57) ABSTRACT

A footwear hanger including a bracing member, a lace-clamping member and an interconnecting member. The bracing member includes a first elongated side wall and a second elongated side wall. The bracing member is configured to be bracingly attached to a strap, such as a backpack shoulder strap or a belt, between the first elongated side wall and the second elongated side wall. The lace-clamping member includes a clamping mechanism and an inner wall surface, wherein at least one shoe lace can be removably clamped by the clamping mechanism. The interconnecting member securely attaches the external surface of the second elongated side wall and the inner wall surface of the lace-clamping member, forming a lacing gap between the second elongated side wall and the inner wall surface of the lace-clamping member. Thereby, facilitating wrapping of the at least one shoe lace onto the interconnecting member.

12 Claims, 6 Drawing Sheets

FOOTWEAR HANGER

FIELD OF THE INVENTION

The present invention relates to real-time footwear hangers and more particularly, the present invention relates to footwear hangers for laced shoes that are typically, with no limitations, attached to a strap of a backpack, a carrying bag, a belt and the like.

BACKGROUND OF THE INVENTION AND PRIOR ART

Typically, shoes take a lot of space in a backpack. They typically also carry a bad odor and stink the inside of the bag and other items being carried therein. There is therefore a need and it would be advantageous to have a device that is easily attached to a strap of a backpack to which shoes can be easily mounted thereon, using the shoe laces, thereby providing a simple, fast, cheap and elegant solution to that problem.

PCT application WO/2011/145127, as disclosed by David Paolo SPINELLI, provides a hook for footwear or footwear hanger that is reversibly connected to the footwear, i.e. it is permanently attached to the upper of the shoe during use, and separable when desired.

U.S. Pat. No. 6,446,849, as disclosed by Jason E, SCHLEIFER, provides a carrying device that includes an elongated strap having first and second ends, at least one clamp at least proximally coupled to one of the first and second ends of said elongated strap, and a securement device coupled to a region proximate at least one of the first and second ends of said elongated strap for coupling together the regions proximate to the first and second ends of the elongated strap.

BRIEF SUMMARY OF THE INVENTION

The present invention discloses a footwear hanger that is easily attached to a strap of a backpack to which shoes can be easily mounted thereon, using the shoe laces, thereby providing a simple, fast, cheap and elegant solution to the problem of avoiding placing such shoes inside a backpack, for example, or for any other reason.

According to teachings of the present invention, there is provided a footwear hanger including a bracing member, a lace-clamping member and an interconnecting member. The a bracing member includes a first elongated side wall and a second elongated side wall, wherein the bracing member is configured to be bracingly attached to a strap, such as a backpack shoulder strap or a belt, between the first elongated side wall and the second elongated side wall.

The lace-clamping member includes a clamping mechanism and an inner wall surface, wherein at least one shoe lace can be removably clamped by the clamping mechanism.

The interconnecting member securely attaches the external surface of the second elongated side wall of the bracing member and the inner wall surface of the lace-clamping member, forming a lacing gap between the external surface of the second elongated side wall of the bracing member and the inner wall surface of the lace-clamping member, facilitating wrapping of the at least one shoe lace onto the interconnecting member. Optionally, the interconnecting member securely attaches the external surface of the first elongated side wall of the bracing member and the inner wall surface of the lace-clamping member, forming a lacing gap between the external surface of the first elongated side wall of the bracing member and the inner wall surface of the lace-clamping member, facilitating wrapping of the at least one shoe lace onto the interconnecting member.

Optionally, the interconnecting member and the bracing member are made of one piece. Optionally, in such configuration, the open end of the interconnecting member includes a slider member that can fittingly accommodate either the first elongated side wall or the second elongated side wall of the bracing member, wherein the interconnecting member slides down over the selected elongated side wall and comes to a stop when reaching a stopper.

Alternatively, the interconnecting member, the second elongated side wall of the bracing member and the bracing member are made of one piece.

Optionally, the first elongated side wall and the second elongated side wall of the bracing member are securely interconnected by an interconnecting-rib, at or proximal to one respective end of the bracing member. The first elongated side wall and the second elongated side wall of the bracing member are securely interconnected by a locking mechanism at or proximal to the second respective end of the bracing member. A strap-receiving gap is formed between the first and second elongated side walls of the bracing member, delimited by the interconnecting-rib, at one end, and by the locking mechanism, at the other end.

Optionally, the clamping mechanism includes a bottleneck portion, a sloped surface and a tenterhook-like shape. The bottleneck portion has a groove formed in a preconfigured location of the side wall of the lace-clamping member. The sloped surface, formed at one end of the clamping mechanism, facilitates easy sliding of a lace towards the bottleneck portion, to be clamped therein. The tenterhook-like shape shapes the bottleneck portion to form a narrow gap, positioned at the end of the sloped surface. The grove then broadens to form a wider gap, wherein the wider gap is wide enough to accommodate at least two laces.

Optionally, the bracing member further includes at least one clamping mechanism, typically disposed at the bottom of either elongated side walls or both.

Optionally, at least one external surface is used as an advertising canvas.

Optionally, the footwear hanger further includes an advertising canvas attached the external surface of the first elongated side wall.

Optionally, the footwear hanger further includes an advertising canvas attached the external surface of the second elongated side wall.

Optionally, the footwear hanger further includes an advertising canvas attached to the external surface of the lace-clamping member.

BRIEF DESCRIPTION OF THE DRAWINGS

The present invention will become fully understood from the detailed description given herein below and the accompanying drawings, which are given by way of illustration and example only and thus not limitative of the present invention, and wherein.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided, so that this disclosure will be thorough and complete, and will fully convey the scope of the invention to those skilled in the art.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments of the inventions. It is understood that the phraseology and terminology employed herein is not to be construed as limiting and are for descriptive purpose only.

Meanings of technical and scientific terms used herein are to be commonly understood as to which the invention belongs, unless otherwise defined. The present invention can be implemented in the testing or practice with methods and materials equivalent or similar to those described herein.

It should be noted that orientation related descriptions such as "top", "bottom", "up", "upper", "down", "low", "lower", "rear", "front" and the like, assumes that the associated item of the footwear hanger is operationally situated, that is, with no limitations, securely attached to a backpack and being faced by a viewer.

The present invention discloses a footwear hanger that is easily attached to a strap of a backpack, for example, to which shoes can be easily wrapped on and clamped, using the shoe laces. Thereby, providing a simple, fast, cheap and elegant solution to the problem of avoiding placing such shoes inside a backpack, for example, or for any other reason.

Figure 1A:
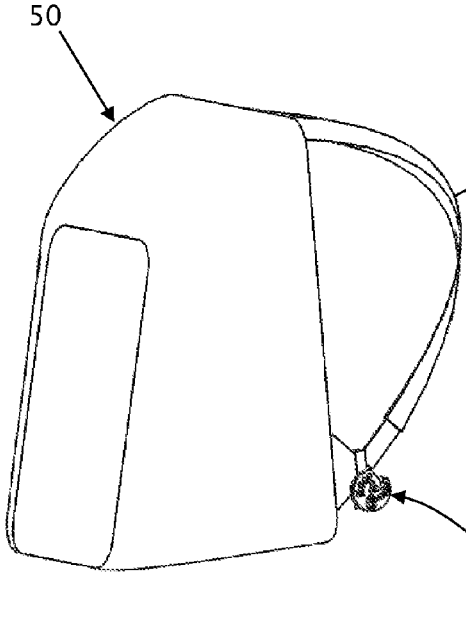
FIG. 1*a*-1*d* illustrate a footwear hanger, according to embodiments of the present invention, being removably attached to straps of various carrying backpacks/bags.
Figure 1B:
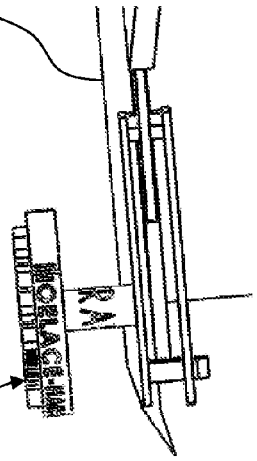
Figure 1C:
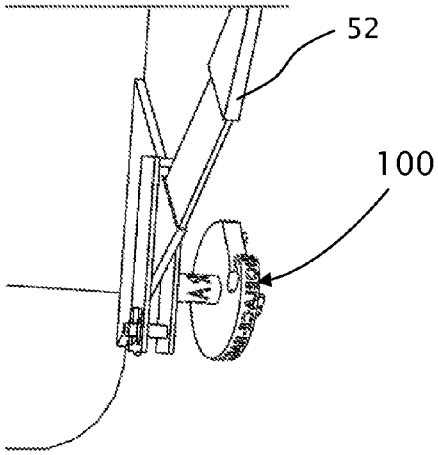
Figure 1D:
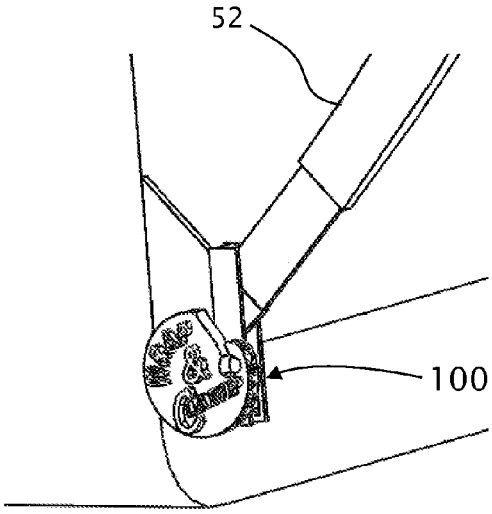
Figure 2:
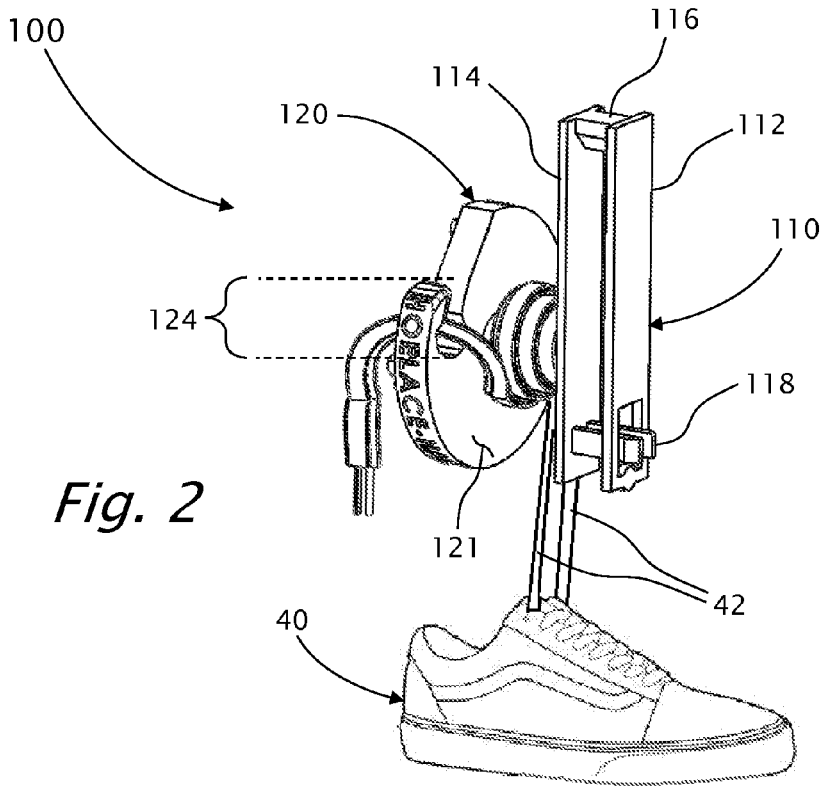
FIG. 2 is a rear perspective view of a footwear hanger, according to embodiments of the present invention, wherein a shoe is mounted thereon.
Figure 3:
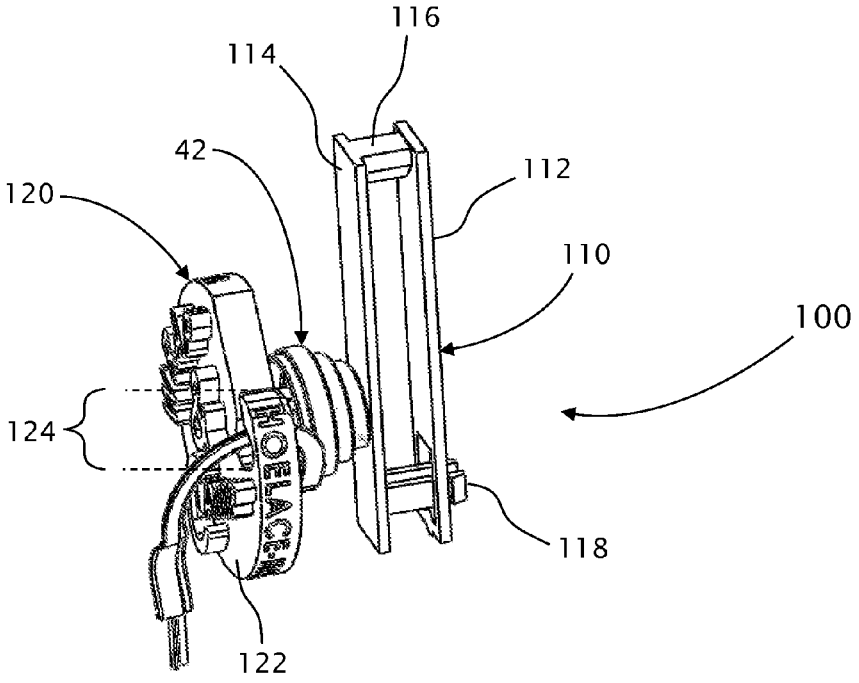
FIG. 3 is a top-side perspective view of the footwear hanger shown in FIG. 2.
Figure 4:
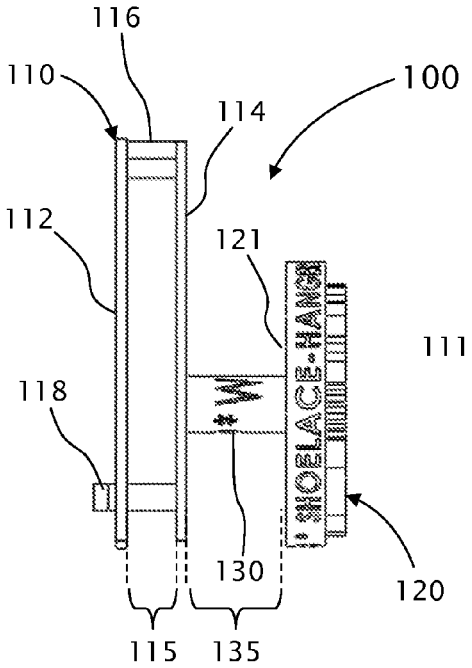
FIG. 4 is a side view of the footwear hanger shown in FIG. 2.
Figure 5:
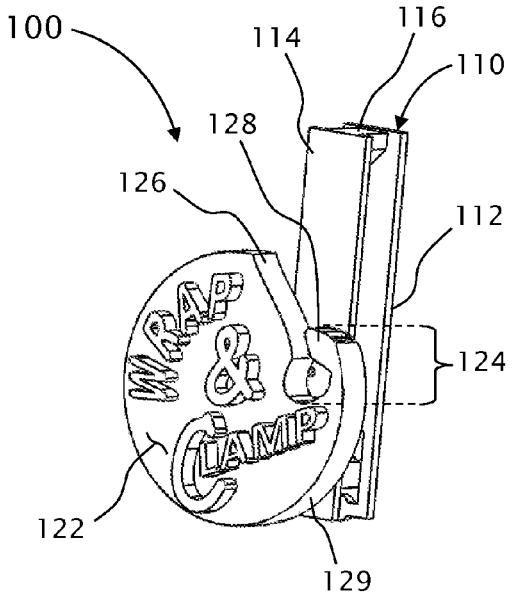
FIG. 5 is a front perspective view of the footwear hanger shown in FIG. 2.

Reference is now made to the drawings. FIG. 1*a*-1*d* illustrate an exemplary footwear hangers 100, according to embodiments of the present invention, being removably attached to straps 52 of various carrying backpack/bags 50; FIG. 2 is a rear perspective view of footwear hanger 100, wherein a shoe 40 is mounted thereon; FIG. 3 is a top-side perspective view of the footwear hanger 100; FIG. 4 is a side view of the footwear hanger 100; and FIG. 5 is a front perspective view of the footwear hanger 100.

Footwear hanger 100 includes a bracing member 110, a lace-clamping member 120 and an interconnecting member 130 that securely connects bracing member 110 with lace-clamping member 120.

Bracing member 110 includes a first elongated side wall 112, a second elongated side wall 114, interconnecting-rib 116 and locking mechanism 118, disposed proximal to the second end of side walls 112 and 114. When locking mechanism 118 interlocks the second ends of side walls 112 and 114, bracing member 110 is in an interlocked state, wherein a strap-receiving gap 115 is formed between side walls 112 and 114. Typically, with no limitations, side walls 112 and 114 have the same length and when in an interlocked state, side walls 112 and 114 are typically, with no limitations, parallel to each other.

Strap-receiving gap 115 is designed to receive a strap of a backpack or a bag, a belt and the like. Furthermore, when in an interlocked state, the height of strap-receiving gap 115, being the distance between interconnecting-rib 116 and locking mechanism 118, is designed to accommodate the width of a strap 52, and the width of strap-receiving gap 115, being the distance between the respective inner surfaces of side walls 112 and 114, is designed to accommodate the width of a strap 52.

Locking mechanism 118 is described herein as a hook locking mechanism, but the present invention is not limited to embody a hook locking mechanism, and any other locking mechanism known in the art may be used within the scope of the present invention. It should be noted that at least one of side walls 112 and 114 is partially flexible to enable operation of locking mechanism 118.

Figure 6:
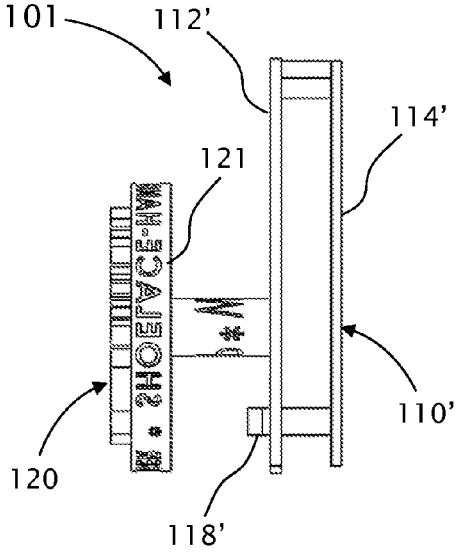
FIG. 6 is a side view of a variation of the footwear hanger shown in FIG. 2.
Figure 7:
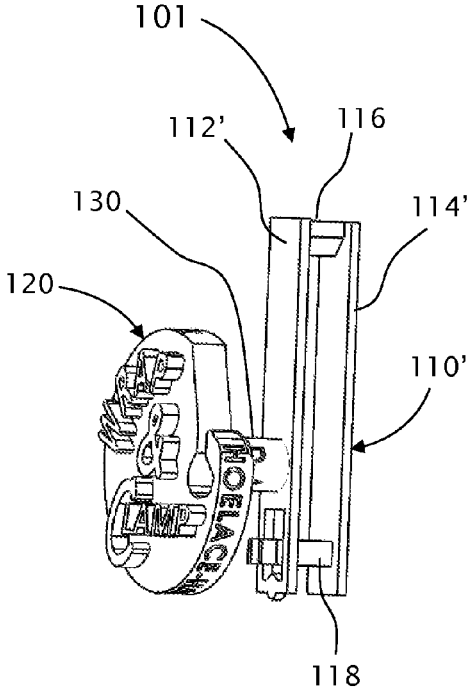
FIG. 7 is a front-side perspective of the footwear hanger shown in FIG. 6.

It should be noted that in some embodiments of the hook/hooks of locking mechanism 118 pass through a locking window formed proximal to the second end of first elongated side wall 112 (see FIG. 4) of bracing member 110 of footwear hanger 100. In other embodiments of the hook/hooks of locking mechanism 118' pass through a locking window formed proximal to the second end of first elongated side wall 112' of bracing member 110' of footwear hanger 101, as shown in FIGS. 6 and 7.

Lace-clamping member 120 is a knob-like element typically, but with no limitations, is flat having an inner wall surface 121 and an external wall surface 122, wherein the inner wall surface 121 of lace-clamping member 120 forms a gap 135 (see FIG. 4).

Interconnecting member 130 securely interconnects bracing member 110 with lace-clamping member 120. Interconnecting member 130 is typically, with no limitations, a cylindrical beam that is securely attached to inner wall surface 121 of lace-clamping member 120 and the external surface of second elongated side wall 114. Gap 135 enables a user of footwear hanger 100 to wrap the laces 42 of a shoe 40, or a pair of shoes, therein, and about interconnecting member 130 (see FIGS. 2 and 3).

Figure 8:
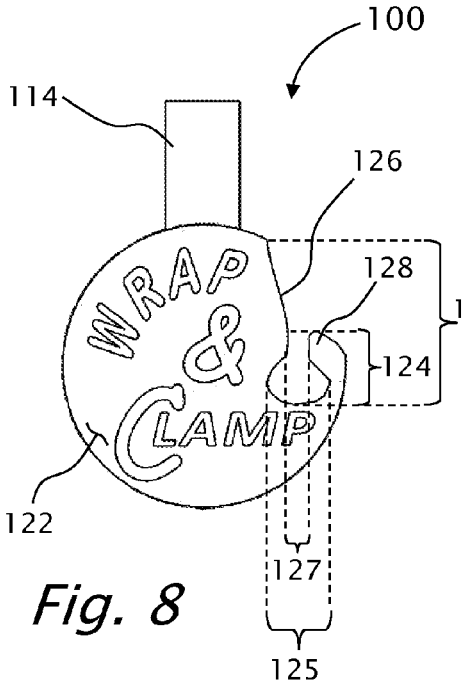
FIG. 8 is a front view of the footwear hanger shown in FIG. 2.
Figure 9:
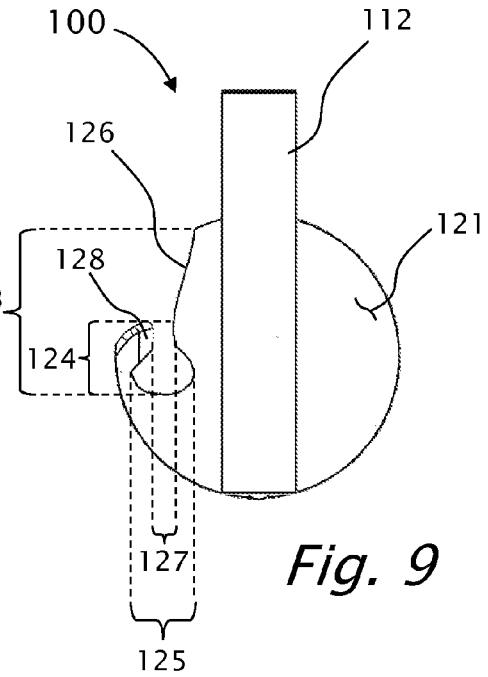
FIG. 9 is a rear view of the footwear hanger shown in FIG. 2.

There are a number of ways to secure shoes 40 onto interconnecting member 130 of footwear hanger 100. One option is to tie the end of the two laces to each other. In a preferred embodiment, a quick laces wrap and clamping mechanism 123 is provided. Reference is also made to FIG. 8, showing a front view of footwear hanger 100, and to FIG. 9, showing a rear view of footwear hanger 100.

Clamping mechanism 123 includes a bottleneck type groove formed in a preconfigured location of the side wall 129 of lace-clamping member 120. At one end of the side-wall profile that forms clamping mechanism 123, a sloped surface 126 facilitate easy sliding of the lace towards the bottleneck portion 124 of clamping mechanism 123. Bottleneck portion 124 of clamping mechanism 123 commences at the lower end of sloped surface 126 where the grove then broadens from a narrow gap 127 to a wider gap 125, as the wall profile that forms clamping mechanism 123 climbs back up to form the opposing sides of the wider gap 125 and the narrow gap 127, and to proceed to merge back with the side wall of lace-clamping member 120, forming a tenterhook-like shape 128.

To clamp laces 42 inside the wider gap 125 of bottleneck portion 124 of clamping mechanism 123, the user forcefully pushes each lace 42 through narrow gap 127 and into wider gap 125, wider gap 125 being wide enough to accommodate up to 4 (four) laces, and possibly more.

Figure 10:
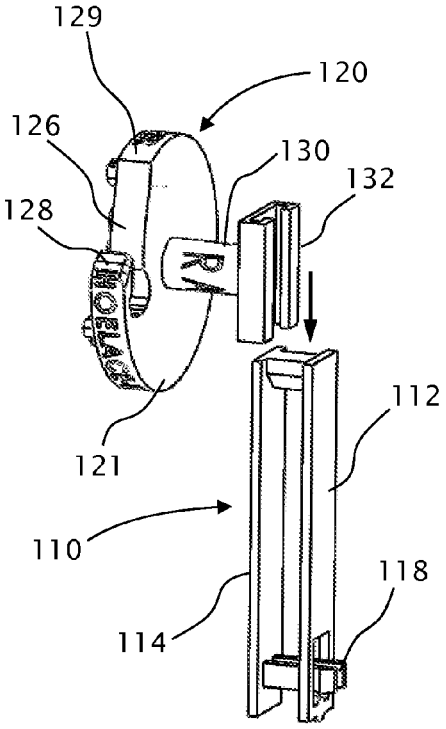
FIG. 10 is an exploded rear-side perspective view of another variation of the footwear hanger shown in FIG. 2, wherein the interconnecting member that connects the bracing member with the lace-clamping member, is detached from the bracing member.
Figure 11:
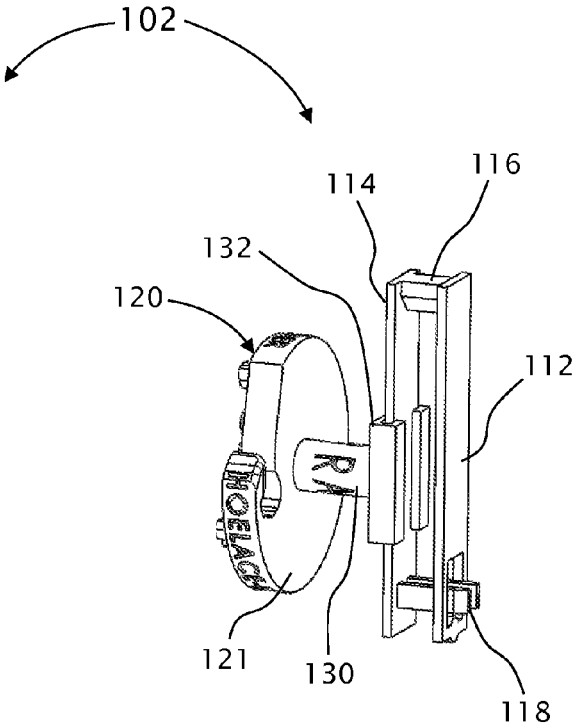
FIG. 11 is a rear-side perspective view of the footwear hanger shown in FIG. 10, wherein the interconnecting member is attached to the bracing member.

Reference is also made to FIG. 10, showing an exploded rear-side perspective view of another variation of a footwear hanger 102, wherein interconnecting member 130 connects bracing member 110 with lace-clamping member 120, is detached from the bracing member 110. FIG. 11 is a rear-side perspective view of footwear hanger 102, wherein interconnecting member 130 is removably attached to bracing member 110. Interconnecting member 130 rather securely interconnects lace-clamping member 120 with a slider member 132. Slider member 132 can fittingly accommodate either first elongated side wall 112 or second elongated side wall 114 of bracing member 110. Interconnecting member 130 slides down over the selected side wall (112 or 114) and comes to a stop when reaching a stopper (not shown).

Figure 12:
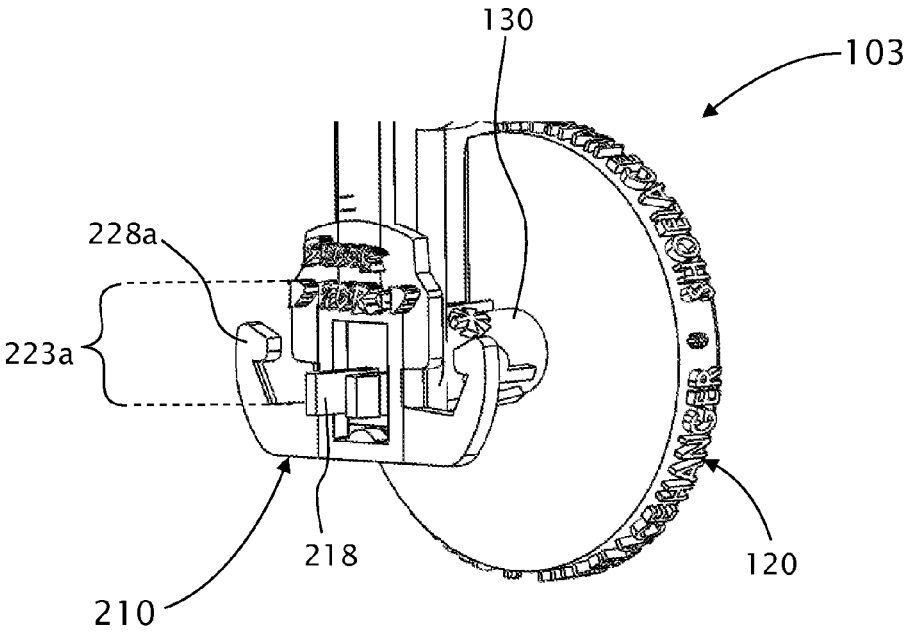
FIG. 12 is a rear-side perspective view of another variation of a footwear hanger, according to embodiments of the present invention.
Figure 13:
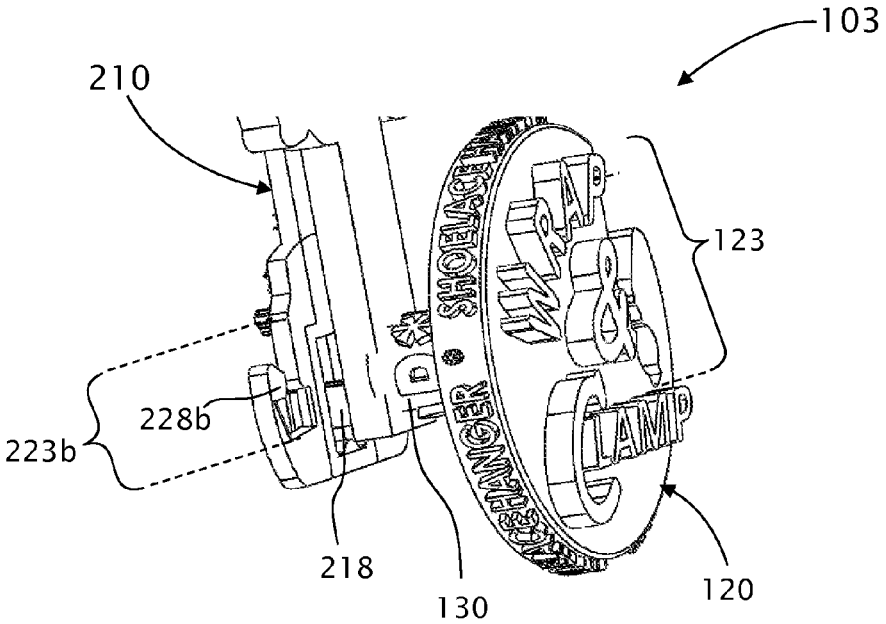
FIG. 13 is a front-side perspective view of the footwear hanger shown in FIG. 12.

Reference is also made to FIG. 12, showing a rear-side perspective view of another variation of a footwear hanger 103, wherein alternative or additional clamping mechanisms 223 are attached or being part of a bracing member 210. FIG. 13 is a front-side perspective view of footwear hanger 103. In the example shown in FIGS. 12 and 13, bracing member 210 includes a pair of clamping mechanisms 223 that are built at the bottom portion of bracing member 210. In general, clamping mechanisms 223*a* and 223*b* are built and designed to operate similarly to clamping mechanisms 123, providing the user more and/or alternative clamping mechanisms to which he/she can clamp laces.

Figure 14:
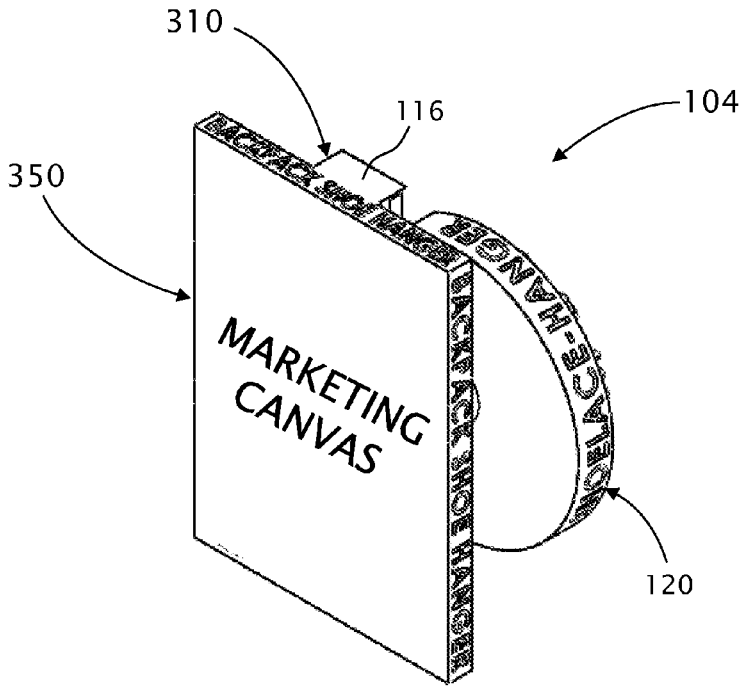
FIG. 14 is a rear perspective view of an example of another variation of a footwear hanger, according to embodiments of the present invention, having an advertising canvas that can be used for commercial advertising.
Figure 15:
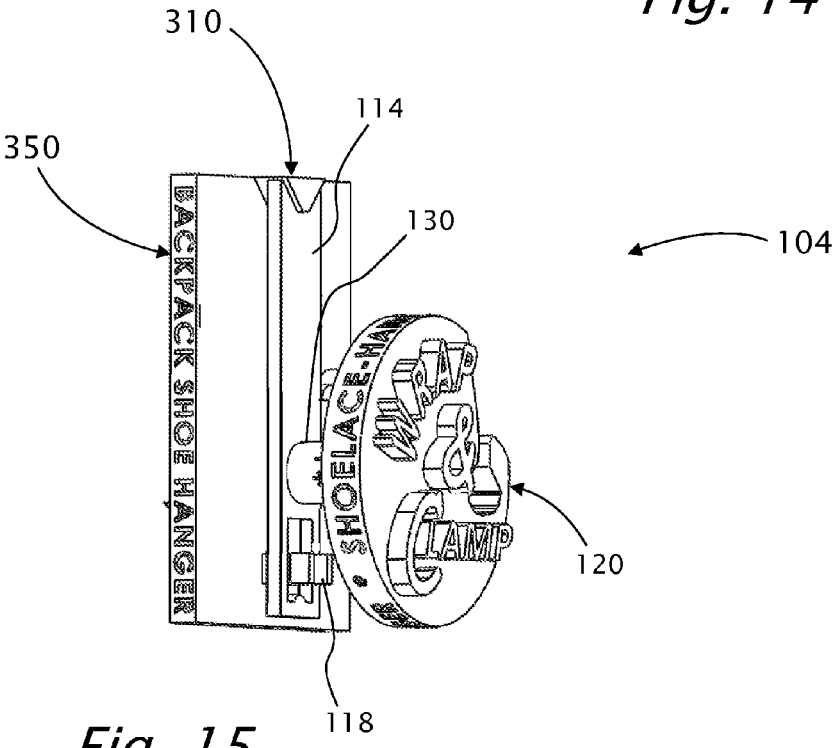
FIG. 15 is a front-side perspective view of the footwear hanger shown in FIG. 14.

Reference is also made to FIG. 14, showing an example of another variation of a footwear hanger 104, wherein an advertising canvas 350 that can be used for commercial advertising is attached to or is integrated with bracing member 310. FIG. 15 is a front-side perspective view of footwear hanger 104. It should be noted that other external surfaces of the footwear hangers 104 footwear hanger (100, 101, 102, 103, 104), according to the various embodiments of the present invention, may be used for commercial advertising.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A footwear hanger comprising:

a) a bracing member having a first elongated side wall and a second elongated side wall;

b) a lace-clamping member having a clamping mechanism and an inner wall surface; and c) an interconnecting member, wherein said bracing member is configured to be bracingly attached to a strap between said first elongated side wall and said second elongated side wall;

wherein at least one shoe lace can be removably clamped by said clamping mechanism of said lace-clamping member;

wherein said interconnecting member securely attaches an external surface of said second elongated side wall of said bracing member and said inner wall surface of said lace-clamping member, forming a lacing gap between the external surface of said second elongated side wall of said bracing member and said inner wall surface of said lace-clamping member, facilitating wrapping of said at least one shoe lace onto said interconnecting member; and wherein said clamping mechanism comprises:

a) a bottleneck portion having a groove formed in a preconfigured location of a side wall of said lace-clamping member;

b) a sloped surface, formed at one end of said clamping mechanism, facilitating easy sliding of a lace towards said bottleneck portion; and c) a hook that shapes a narrow gap formed at one end of said sloped surface, said grove then broadens to form a wider gap, wherein said wider gap is wide enough to accommodate at least two laces.

2. A footwear hanger as in claim 1, wherein said interconnecting member and said bracing member are made of one piece.

3. A footwear hanger as in claim 1, wherein said interconnecting member, said second elongated side wall of said bracing member and said bracing member are made of one piece.

4. A footwear hanger as in claim 1, wherein said first elongated side wall and said second elongated side wall of said bracing member are securely interconnected by an interconnecting-rib at or proximal to one respective end of said bracing member;

wherein said first elongated side wall and said second elongated side wall of said bracing member are securely interconnected by a locking mechanism at or proximal to a second respective end of said bracing member;

wherein a strap-receiving gap is formed between said first and second elongated side walls of said bracing member; and wherein said strap-receiving gap is delimited by said interconnecting-rib, at one end, and by said locking mechanism, at the other end.

5. A footwear hanger as in claim 1, wherein said interconnecting member securely attaches an external surface of said first elongated side wall of said bracing member and said inner wall surface of said lace-clamping member, forming a lacing gap between the external surface of said first elongated side wall of said bracing member and said inner wall surface of said lace-clamping member, facilitating wrapping of said at least one shoe lace onto said interconnecting member.

6. A footwear hanger comprising:

a) a bracing member having a first elongated side wall and a second elongated side wall;

b) a lace-clamping member having a clamping mechanism and an inner wall surface; and c) an interconnecting member, wherein said bracing member is configured to be bracingly attached to a strap between said first elongated side wall and said second elongated side wall;

wherein at least one shoe lace can be removably clamped by said clamping mechanism of said lace-clamping member;

wherein said interconnecting member securely attaches an external surface of said second elongated side wall of said bracing member and said inner wall surface of said lace-clamping member, forming a lacing gap between the external surface of said second elongated side wall of said bracing member and said inner wall surface of said lace-clamping member, facilitating wrapping of said at least one shoe lace onto said interconnecting member; and wherein an open end of said interconnecting member comprises a slider member that can fittingly accommodate either said first elongated side wall or said second elongated side wall of said bracing member, wherein said interconnecting member slides down over said selected elongated side wall and comes to a stop when reaching a stopper.

7. A footwear hanger as in claim 1, wherein said bracing member further comprises at least one clamping mechanism.

8. A footwear hanger as in claim 7, wherein said at least one clamping mechanism is disposed at the bottom of said first or second elongated side wall.

9. A footwear hanger as in claim 1, wherein at least one external surface of the footwear hanger is used as an advertising canvas.

10. A footwear hanger as in claim 1 further comprising an advertising canvas attached to an external surface of said first elongated side wall.

11. A footwear hanger as in claim 1 further comprising an advertising canvas attached to the external surface of said second elongated side wall.

12. A footwear hanger as in claim 1 further comprising an advertising canvas attached to an external surface of said lace-clamping member.

* * * * *